United States Patent [19]

Weinrotter et al.

[11] Patent Number: 4,801,502

[45] Date of Patent: Jan. 31, 1989

[54] NON-FLAMMABLE, HIGH-TEMPERATURE RESISTANT POLYIMIDE FIBERS MADE BY A DRY SPINNING METHOD

[75] Inventors: Klaus Weinrotter, Vöcklabruck; Thomas Jeszenszky, Kammer; Heinrich Schmidt, Vöcklabruck; Siegfried Baumann, Timelkam; Johann Kalleitner, Schörfling, all of Austria

[73] Assignee: Chemiefaser Lenzing Aktiengesellschaft, Lenzing, Austria

[21] Appl. No.: 48,975

[22] Filed: May 11, 1987

Related U.S. Application Data

[63] Continuation of Ser. No. 818,989, Jan. 10, 1986, abandoned, which is a continuation of Ser. No. 584,477, Feb. 28, 1984, abandoned.

[30] Foreign Application Priority Data

Mar. 9, 1983 [AT] Austria ..... 820/83

[51] Int. Cl.[4] ..... D01D 5/04; D01F 6/74

[52] U.S. Cl. ..... 428/397; 428/359; 428/364; 264/151; 264/168; 264/177.13; 264/177.17; 264/205; 264/134; 264/210.3; 264/210.7; 264/210.8; 264/211.15; 264/211.17; 264/233

[58] Field of Search ..... 264/205, 171 F, 184, 264/151, 168, 177.13, 177.17, 134, 210.3, 210.7, 210.8, 211.15, 211.17, 233; 428/364, 397, 400, 359

[56] References Cited

U.S. PATENT DOCUMENTS

| | | | |
|---|---|---|---|
| 3,717,696 | 2/1973 | Rochina et al. | 264/205 |
| 3,985,934 | 10/1976 | Farrissey, Jr. et al. | 264/184 |
| 4,370,290 | 1/1983 | Makino et al. | 264/184 |

FOREIGN PATENT DOCUMENTS

| | | |
|---|---|---|
| 0040042 | 1/1981 | European Pat. Off. . |
| 2102333 | 2/1983 | United Kingdom . |

*Primary Examiner*—Jan H. Silbaugh
*Assistant Examiner*—Hubert C. Lorin
*Attorney, Agent, or Firm*—Brumbaugh, Graves, Donohue & Raymond

[57] ABSTRACT

Non-flammable, high-temperature resistant polyimide fibers have irregularly lobed or serrated cross-sections, a wool-like smooth hand and high brightness. They are produced by a dry-spinning process which is carried out in a spinning column, wherein a 20 to 40% solution of the polyimide is spun from spinnerets having circular orifices, the orifice numbers ranging from 20 to 800 and the orifice diameters from 100 to 300 μm. An extrusion speed of between 20 and 100 m/min, a take-up speed of between 100 and 800 m/min, an amount of spin gas between 40 and 100 $m^3/h$ under standard conditions and a spin gas temperature of between 200° and 350° C. are applied. The tows leaving the spinning column, which contain residual solvent from 5 to 25% by weight—based on dry polymer—and have a single filament titer of between 3.5 and 35 dtex, are washed in hot water, then they are dried to a moisture content of less than 5%, subsequently are drawn at high temperatures and, if desired, are crimpled and cut into staple fibers.

3 Claims, 1 Drawing Sheet

NON-FLAMMABLE, HIGH-TEMPERATURE RESISTANT POLYIMIDE FIBERS MADE BY A DRY SPINNING METHOD

BACKGROUND OF THE INVENTION

This application is a continuation of application Ser. No. 818,989, filed Jan. 10, 1986, now abandoned, which is a continuation of application Ser. No. 584,477, filed Feb. 28, 1984, now abandoned.

The invention relates to a method of producing non-flammable, high-temperature-resistant polyimide fibers according to the dry-spinning technique from a solution in aprotic organic solvents.

Heat-resistant polymers have been known for a long time. They contain aromatic groups in their molecule chains so as to form highly conjugated bond systems, which are essential for high-temperature resistance. Examples for that are aromatic polyamides and polyimides, where the temperature resistance was substantially increased by substitution of aliphatic groups by aromatic groups.

A disadvantage for their technological application is the fact that they are normally neither soluble in solvents nor meltable. Therefore, they cannot be processed by extrusion, melt-spinning, dry-spinning, wet-spinning or similar procedures, like other synthetic materials.

In order to avoid these difficulties it was proposed to prepare as a prepolymer a polyamide acid by condensation of tetracarboxylic acid dianhydride with a diamine under relatively mild conditions in a first step. Thus any amine group primarily reacts with one of the two respective available carboxyl groups of the anhydride. This polyamide acid is soluble, and sheets, films or fibers may be formed from its solutions. Subsequently, the solvent is evaporated from these products and upon further heating polyimide is formed.

However, this method has some serious disadvantages: the intermediate compound is very sensitive to hydrolytic degradation and water is formed during the final condensation step to polyimide. Water can escape from the interior of the shaped products (sheets, films, fibers) by diffusion only. If this reaction is carried out too fast, the evaporating water forms bubbles which cause voids within the final product. These are detrimental to the end-use properties.

Another proposal to obtain non-flammable, high-temperature-resistant polymers is disclosed in DE-PS No. 2 143 080. The copolyimides described in that patent are soluble in polar aprotic organic solvents, such as dimethylformamide, dimethylacetamide,N-methylpyrrolidone or dimethylsulfoxide. The polymers are produced by solution condensation of benzophenone tetracarboxylic acid dianhydride with a mixture of toluylene diisocyanate and diphenyl methane diisocyanate in one of the above mentioned solvents. The polymer can be further processed directly from these solutions. According to DE-OS No. 2 442 203 fibers can be produced from the solutions, particularly by wet-spinning. The fiber cross-section varies depending on the spin bath chosen. When using water with varying amounts of a polar aprotic solvent (e.g. dimethylformamide, dimethylacetamide, N-methylpyrrolidone or the like), the fiber cross-section will be round or elliptical. When using glycerin in the spin bath, pseudo hollow fibers with a narrow longitudinal slot and a serrated outer side will form. As to dry spinning, only general remarks without any indication as to the fiber properties attainable are found in DE-OS No. 24 42 203.

Thus the production of polyimide fibers by dry-spinning from solutions containing polymers formed of benzophenone tetracarboxylic acid dianhydride and a mixture of toluylene diisocyanate and diphenylmethane diisocyanate has not been satisfactorily achieved till today. Due to avoiding coagulation baths and being able to recover spinning solvents more easily in case of dry-spinning, fiber production by dry-spinning is more favorable than by wet spinning even from an economical point of view.

Fibers with lobed or serrated cross-sections have proved to show better end-use characteristics in textile applications. It is known in the art to obtain such fibers by dry or melt spinning by means of spinneret orifices with appropriate cross-sections, for instance cross-like or asterisk-like. Thus it is described e.g. in DE-OS No. 30 40 970 that acrylic fibers with a modified cross-section can be obtained by dry-spinning by means of said spinneret orifices. In addition to the difficult and expensive production of spinneret plates having complicated orifices, they also corrode substantially faster than those having circular orifices. Despite of these disadvantages this method has been used to produce fibers with better end-use properties, in particular improved soiling behavior, increased dye brightness, a good hand and improved overall textile characteristics.

Round fiber cross-sections are obtained by melt spinning when using circular orifices whereas a dog-bone shaped fiber cross-section is obtained by dry-spinning of solutions. Thus, the same result was to be expected when using polyimide solutions in a conventional dry-spinning method.

SUMMARY OF THE INVENTION

It is the object of this invention to manufacture fibers of non-flammable, high-temperature-resistent polyimide polymers by a dry-spinning method. Those fibers should show improved end-use properties, having in particular an irregular fiber cross-section. Thereby is guaranteed a good hand and high brightness as well as an improved area coverage at an equal area mass as compared to fibers having a circular cross-section.

According to the invention, this object is achieved with a method of the initially defined kind by departing from a polyimide polymer comprising units of the general formula

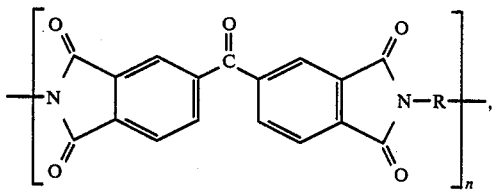

(I)

wherein R is present partly as a group of the formula

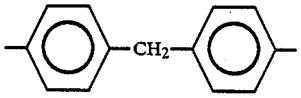

and partly as a group of the formula

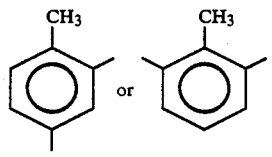

in that, in order to obtain fibers having irregularly lobed or serrated cross-sections, a wool-like, smooth hand and high brightness, the dry-spinning process is carried out in a spinning column, wherein a solution containing 20 to 40% by weight of the polyimide is spun from spinnerets having circular orifices, the number of orifices ranges from 20 to 800 and their diameter from 100 to 300 μm, an extrusion speed of between 20 and 100 m/min and take-up speeds of between 100 and 800 m/min are applied, and spin gas in an amount of between 40 and 100 $m^3/h$, under standard conditions of temperature and pressure, i.e., a temperature of 0° C. and a pressure of 760 mm Hg (hereinafter standard conditions) and at a temperature of between 200° C. and 350° C. is used, the fiber bundle or tow leaving the column has a residual solvent content of from 5 to 25% by weight - based on dry polymer - and a single filament titer of between 3.5 and 35 dtex, is washed in hot water, then dried to a moisture content of less than 5%, subsequently drawn at high temperature and, if desired, is crimped and cut into staple fibers.

DETAILED DESCRIPTION OF THE INVENTION

As is known, the production of the polymers may be carried out by reacting benzophenone tetracarboxylic acid dianhydride, toluylene diisocyanate and diphenylmethane diisocyanate in an aprotic organic solvent, whereby a solution of the polymer is obtained. It is, however, also possible to dissolve the solid powdered polymer continuously or discontinuously in an aprotic solvent, such as dimethylacetamide, N-methylpyrrolidone or dimethylsulfoxide, preferably dimethylformamide. The dissolution temperature is chosen between 30° C. and 120° C. Preferably a solution having a content of between 25 and 35% by weight is prepared. The solution obtained is deaecated, may be filtered once or several times and is supplied to the spinning head of a dry-spinning equipment via a spin pump.

The output of one dry-spinning column may vary between 20 and 400 kg of fibers/d, preferably between 150 and 300 kg/d.

Depending on the layout of the plant, several spinning columns may be combined into a so-called "spinning assembly" or "spinning machine". The technical design of the spinning head, of the spinning column, and of the entire spinning assembly may be similar to that which is common with the dry-spinning of acrylic fibers.

Very surprisingly, heavily lobed and irregularly serrated fiber cross-sections are obtained according to the invention when dry-spinning from circular orifices by observing the indicated spinning conditions.

Figure 1:
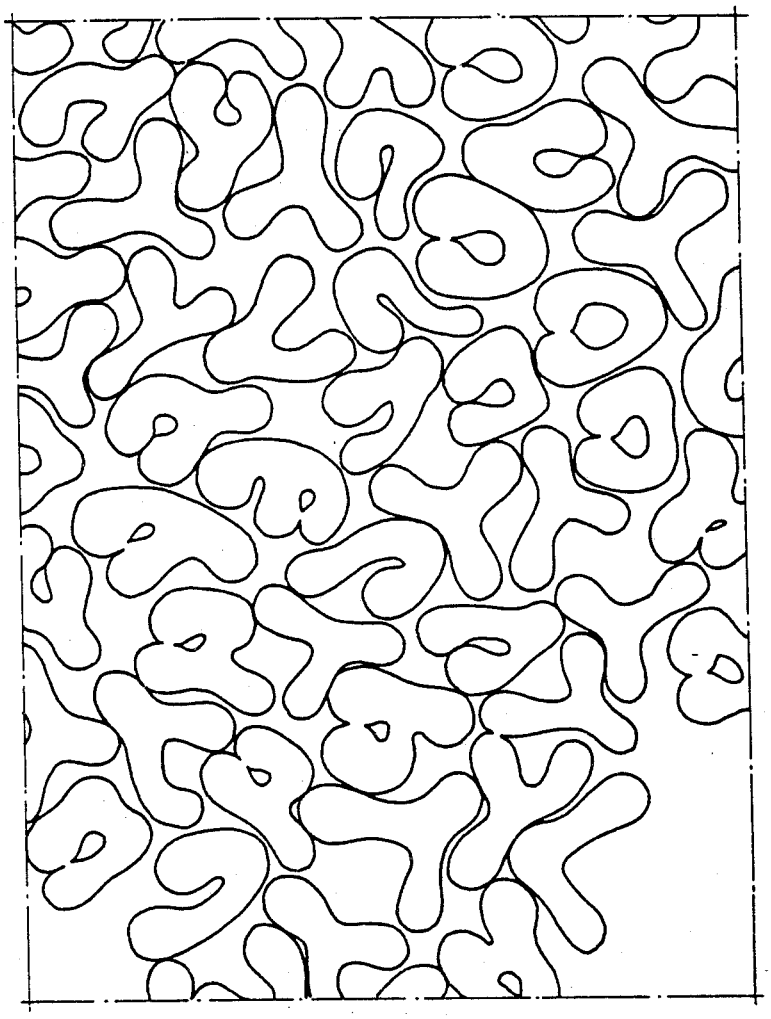
FIG. 1 is a representation of typical fiber cross-sections obtained in accordance with the invention.

In FIG. 1 typical fiber cross-sections of a fiber bundle obtained in this manner are illustrated.

Although the single filaments have approximately similiar fiber titers, the cross-sections are irregular and have heavily profiled shapes. They resemble such letters as e.g. W, U, C, Y, E, V, T, X. These fiber cross-sectional shapes, which do not change even during the subsequent aftertreatment of the fibers, constitute a property that has long been sought by textile technicians, causing the above-mentioned improvement of the end-use properties. The typical fiber bundle cross-sections shown in FIG. 1 do not depend on the number of orifices in the spinneret, provided the orifices are circular. This was proven with spinnerets with 100 as well as with 200, 400, 600 and 800 orifices.

The tow leaving the dry-spinning column and obtained in the manner described, also called "as-spun tow", is intermittently wound on spools or stored in cans for aftertreatment. For that purpose, it is advantageously washed with water initially at temperatures ranging from 80° C. to 100° C. at take-in speeds from 2 to 20 m/min, is then pre-finished, dried at temperatures between 120° C. and 300° C. over a perforated cylinder or calander drier until the moisture of the tow after the drier amounts to less than 5%. The tow is then drawn in one or several steps at a ratio ranging from 1:2 to 1:10 at temperatures of between 315° C. and 450° C. It is finished a second time with a common preparation, is crimped in a stuffer box crimping machine at room temperature and is finally cut into staple fibers, or is put on spools after the drawing procedure in case of the production of continuous filaments.

By intensive washing with hot water, the fibers are freed from residual solvent. Pre-finishing with a commercially available antistatic agent helps to guide the fiber tow through the drier without problems. To maintain the moisture content of less than 5% after drying is important in order to be able to carry out the subsequent high-temperature drawing without difficulties. This high-temperature drawing is carried out either over heated rolls, a hot plate or in a hot air oven, and it may take place in a single step or in several steps. To observe temperatures between 315° C. and 450° C. during drawing is necessary because of the high glass transition temperature of the polyimide fibers (about 315° C.).

Despite the high glass transition temperature of the polymers, satisfactory crimp can be applied with conventional stuffer box crimping machines at temperatures of less than 100° C., which makes it possible to further process the staple fibers on common textile machinery. Post-finishing is carried out with commercially available finishes for synthetic fibers, which may be cationic and/or anionic and/or nonionogenic in character. Post-finishing need not necessarily be carried out directly after high-temperature drawing, but may also be done after crimping. Cutting into staple fibers is effected by commercially available cutting machines. In case of the production of continuous yarns, tows having the desired titer are separately guided through the aftertreatment plant and are wound on spools after high-temperature drawing and, if necessary, finishing.

The conditions that must be observed in the individual steps of the method according to the invention are summarized in the following list:

| | |
|---|---|
| Dissolution: | |
| concentration of solution | 20 to 40% by weight |

-continued

| | |
|---|---|
| preferred | 25 to 35% by weight |
| temperature during dissolution procedure | 30 to 120° C. |
| preferred | 40 to 80° C. |
| Spinning: | |
| single column output | 20 to 400 kg/d |
| preferred | 150 to 300 kg/d |
| spinneret orifice number | 20 to 800 orifices/spinneret |
| orifice diameter | 100 to 300 μm |
| preferred | 150 to 200 μm |
| orifice shape | circular |
| extrusion speed | 20 to 100 m/min |
| take-up speed | 100 to 800 m/min |
| single filament titer of tow leaving column | 3.5 to 35 dtex |
| amount of spin gas | 40 to 100 $m^3$/h (based on standard conditions) |
| spin gas temperature | 200 to 350° C. |
| residual solvent content of tow leaving column | 5 to 25% |
| Aftertreatment: | |
| initial speed of tow | 2 to 20 m/min |
| temperature of washing baths | 80 to 100° C. |
| temperature of drier | 120 to 300° C. |
| moisture of tow after drier | less than 5% |
| drawing | in one or several steps |
| total draw ratio | 1:2 to 1:10 |
| preferred | 1:3 to 1:7 |
| drawing temperature | 315 to 450° C. |
| preferred | 330 to 390° C. |
| crimping | stuffer box crimping technique |
| final speed of tow | 6 to 100 m/min |
| preferred | 30 to 70 m/min |

The dry-spun polyimide fibers produced according to the method of the invention are characterized by the following properties:

Non-flammable: the fibers have a LOI (Limiting Oxygen Index) according to ASTM D-2863 of higher or equal 33% $O_2$.

The fibers do not melt, but decompose at temperatures higher than 450° C.

Thermostability: the measurements carried out so far indicate that the polyimide fibers produced according to the above method resist permanent temperature exposure of up to 260° C. without remarkably losing their fiber properties.

Figure 2:
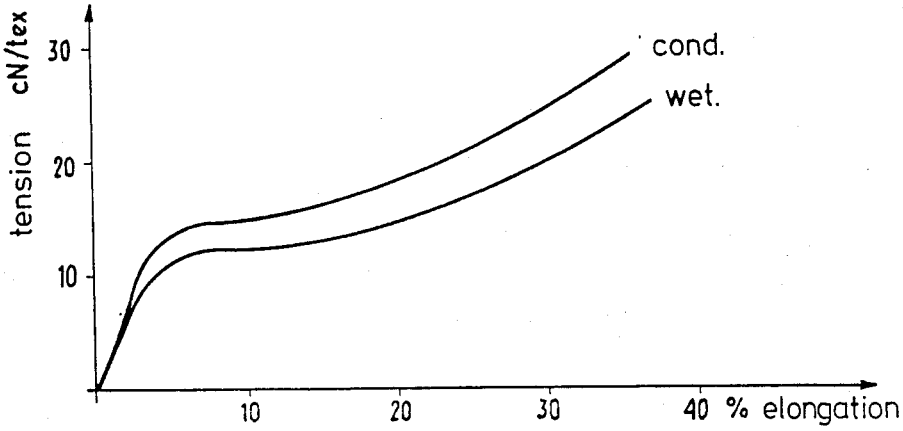
FIG. 2 is a tension vs. elongation curve for a fiber made in accordance with the invention.

Textile-mechanical fiber data:

excellent stress-strain-behavior (a typical tension-/elongation diagram is shown in FIG. 2)
very good knot and loop tenacity
low fiber shrinkage in boiling water (less than 0.5%)
irregular lobed or serrated fiber cross-section
limited water-retention capacity
high brightness
good hand similiar to wool
final fiber titer variable from 0.6 to 10 dtex Color: the natural color of the polyimide fibers produced according to the above method is golden yellow.

The method according to the invention will be explained in more detail in the following examples:

EXAMPLE 1

9 kg of polyimide of the general formula (I) are dissolved in a stirred vessel in 24.3 kg dimethylformamide for 30 min at a temperature of 30° C. Subsequently the mixture is converted into a spinning solution by heating for 40 min at 60° C., deaerated at a pressure of 507 mbar (abs.), filtered and supplied to the spinning head of a dry-spinning column via a gear pump. It is spun through a 240-orifice spinneret, the orifices having circular shape and a diameter of 175 μm. The temperature of the spinning solution prior to entering the spinneret stack is 70° C. The spin gas temperature at the spinneret stack is 295° C., and at the end of the 8 m high spinning column it is 115° C., the amount of spin gas being 60 $m^3$/h (based on standard conditions). The column output is adjusted to 150 kg fibers/d. The as-spun tow, which has an overall titer of 2460 dtex and a residual content of dimethylformamide of 15% by weight, based on dry polymer, is collected on spools. Several of these are combined into a larger tow having an overall titer of 184,800 dtex. This larger tow is subsequently washed in water of 90° C., given an antistatic finish in an immersion bath, dried at 180° C. over a perforated cylinder drier and then drawn at a ratio of 1:5 over a hot plate. The surface temperature of the hot plate is 380° C. The resulting drawn tow is finished with a mixture of cation-active/nonionogenic preparation, crimped in a stuffer box crimping machine at room temperature and cut into staple fibers of 40 mm length. The fibers, which have a final titer of 2.2 dtex, have a tenacity of 28 cN/tex, the fiber elongation at break being 34%, the loop tenacity 15 cN/tex, the knot tenacity 20 cN/tex, and the boiling water shrinkage 0.4%.

The cross-sections of the fibers show a pronounced lobed or serrated shape (as illustrated in FIG. 1). Their LOI value, measured on a knitted hose produced from the fibers with an area mass of 150 g/$m^2$, amounts to 37% $O_2$. In case the fibers are exposed to a temperature of 260° C. over a period of 250 h, the fiber data given do not change, i.e. the fiber is thermostable at the indicated temperature. The moisture regain of the fibers is about 2.7% at 20° C. and at a relative humidity of 65%.

EXAMPLE 2

11 kg of polyimide of the composition described in example 1 are dissolved in a stirred vessel in 25 kg dimethylformamide for 40 min at a temperature of 50° C. Thereafter, the mixture is converted into a spinning solution containing 31.5% polymer by heating at 80° C. for 1 h, is deaerated at a pressure of 467 mbar (abs.), filtered and supplied to the spinning head of a dry-spinning column via a gear pump. Spinning is carried out through a 600-orifice spinneret, the orifices having a circular shape and a diameter of 150 μm. The temperature of the spinning solution, prior to entering the spinneret stack, is 90° C. The spin gas temperature at the spinneret stack is 320° C. and at the end of the spinning column is 120° C., the amount of spin gas being 70 $m^3$/h (based on standard conditions). The column output is adjusted to 200 kg fibers/d. The as-spun tow, which has an overall titer of 7140 dtex and a residual solvent content of 17% by weight, based on dry polymer is collected on spools. Several of these are combined into a larger tow having an overall titer of 357,000 dtex. As in example 1, this larger tow is washed, finished, dried, and subsequently drawn in two steps over heated rolls. The total draw ratio is 1:7, the surface temperature of the heated rolls being 340° C. Said larger tow is crimped in a stuffer box crimping machine at room temperature, then treated with an non-ionogenic finish by spray finishing and cut into staple fibers.

The fibers, which have a final titer of 1.7 dtex, have a tenacity of 30 cN/tex, an elongation to break of 30%, and a boiling water shrinkage of 0.45%.

The cross-sections of the fibers show the characteristic shapes illustrated in FIG. 1 and described in example 1.

EXAMPLE 3

A 25% solution of polyimide (composition as in example 1) in dimethylformamide obtained by polycondensation was filtered and directly filled into the deaerating vessel. The further treatment of the solution is carried out as in example 1. Spinning of the solution takes place through a 240-orifice spinneret, the orifices having a circular shape and a diameter of 175 μm. The temperature of the spinning solution, prior to entering the spinneret stack, is 60° C. The spin gas temperature at the spinneret stack is 260° C. and 110° C. at the end of the spinning column, the amount of spin gas being 55 $m^3/h$ (based on standard conditions). The column output is adjusted to 130 kg fibers/d. The as-spun tow, which has an overall titer of 6240 dtex and a residual solvent content of 20% by weight, based on dry polymer, is collected on spools. Several spools are then subjected to the aftertreatment process at the same time: the individual tows, each having an overall titer of 6240 dtex, are aftertreated in parallel, i.e. are washed, finished, and dried. Drawing is carried out in one step in a hot-air oven, the draw ratio being 1:4.7. The air temperature during drawing is 420° C. The drawn tows subsequently are wound separately on cross-wound spools as continuous filament bundles. The single filaments, which have a titer of 5.5 dtex, have a tenacity of 24 cN/tex, an elongation to break of 40%, and a boiling water shrinkage of 0.3%.

The cross-sections of the filaments show the characteristic shape illustrated in FIG. 1.

What we claim is:

1. Non-flammable, high temperature resistant polyimide fibers comprising units of the general formula

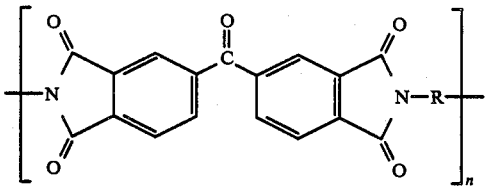

wherein R is present partly as a group of the formula

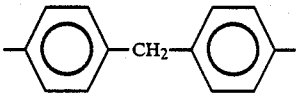

and partly as a group of the formula

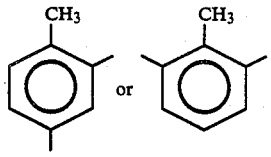

produced by dry spinning in a spinning column a 20 to 40% solution of said polyimide in aprotic organic solvents from spinnerets having circular orifices, orifice numbers ranging from 20 to 800 and orifice diameters of from 100 to 300 μm, applying an extrusion speed of between 20 and 100 m/min, a take-up speed of between 100 and 800 m/min, an amount of spin gas between 40 and 100 $m^3/h$ at standard conditions, and a spin gas temperature between 200° and 350° C., to obtain a tow leaving the spinning column having a residual solvent content of 5 to 25% by weight - based on the dry polymer - and a single filament titer of between 3.5 and 35 dtex, washing said tow in hot water, drying said tow to a moisture content of less than 5%, and drawing said tow at high temperature, said fibers having a wide variety of irregularly lobed or serrated cross-sections resembling the letters W, U, C, Y, E, V, T and X, a wool-like smooth hand and a high-brightness.

2. The polyimide fibers produced as set forth in claim 1 wherein said tow is washed in water at take-in speeds of from 2 to 20 m/min, at temperatures of between 80° and 100° C., pre-finished, dried at temperatures of between 120° and 300° C. to a moisture content of less than 5%, drawn in at least one step at a ratio of from 1:2 to 1:10 at temperatures of between 315° and 450° C., post-finished with a conventional preparation, crimped at room temperature, and cut into fibers.

3. The polyimide fibers produced as set forth in claim 1 wherein said solvent is selected from the group consisting of dimethylacetamide, dimethylsulfoxide, N-methylpyrrolidone and dimethylformamide.

* * * * *